US005826602A

United States Patent [19]

Chen

[11] Patent Number: 5,826,602

[45] Date of Patent: Oct. 27, 1998

[54] PROCESS AND APPARATUS FOR FLUSHING CARBON DEPOSITS AND CONTAMINANTS FROM THE FUEL AND AIR INTAKE SYSTEMS OF AN INTERNAL COMBUSTION ENGINE

[76] Inventor: We-Yu Chen, 3708 Avalon Blvd., Los Angeles, Calif. 90011

[21] Appl. No.: 643,122

[22] Filed: Apr. 30, 1996

[51] Int. Cl.[6] ..... B08B 7/00; B08B 3/00; F23J 1/00; F02B 77/00

[52] U.S. Cl. ..... 134/20; 134/57; 123/198 A

[58] Field of Search ..... 134/20, 57; 123/198 A

[56] References Cited

U.S. PATENT DOCUMENTS

| | | | |
|---|---|---|---|
| 4,197,140 | 4/1980 | Swan | 134/20 |
| 4,520,773 | 6/1985 | Koslow | 123/198 A |
| 4,606,311 | 8/1986 | Reyes et al. | 123/198 A |
| 4,787,348 | 11/1988 | Taylor | 123/198 R |
| 4,877,043 | 10/1989 | Carmichael et al. | 134/57 |
| 4,989,561 | 2/1991 | Hein et al. | 123/198 A |
| 5,097,806 | 3/1992 | Vataru et al. | 123/198 A |
| 5,257,604 | 11/1993 | Vataru et al. | 123/198 A |
| 5,271,361 | 12/1993 | Flynn | 123/198 A |
| 5,287,834 | 2/1994 | Flynn | 123/198 A |
| 5,289,837 | 3/1994 | Betancourt | 134/57 |
| 5,381,810 | 1/1995 | Mosher | 134/56 R |

*Primary Examiner*—Lynette F. Smith
*Attorney, Agent, or Firm*—Darby & Darby

[57] ABSTRACT

This invention comprises an improved process and apparatus for flushing carbon deposits and contaminants from fuel and air intake systems of an internal combustion engine. The process includes replacing the regular fuel supply with a mixture of fuel and a cleaning agent, operating the engine at idle speed and introducing another cleaning agent through the air intake system. The first and second cleaning agents can be of the same or different composition. By simultaneously introducing cleaning agents through the fuel supply system and the air intake system, the process combines the two cleaning agents on the surface area around the intake valves, the combustion chambers and other critical areas to remove stubborn carbon deposits.

9 Claims, 5 Drawing Sheets

PROCESS AND APPARATUS FOR FLUSHING CARBON DEPOSITS AND CONTAMINANTS FROM THE FUEL AND AIR INTAKE SYSTEMS OF AN INTERNAL COMBUSTION ENGINE

BACKGROUND OF THE INVENTION

This invention relates generally to an improved process for flushing carbon deposits and contaminants from the fuel and air intake systems of an internal combustion engine. Specifically, while the engine is warm and operating at idle, the present invention introduces two or more specially formulated, non-destructive and non-corrosive cleaning agents into the engine through regular fuel and air intake systems. This quickly removes any olefin, gum, varnish, oil sludge, soft carbon and other contaminants in the fuel and air intake systems without damaging sensitive components normally found in these systems. By choosing different entry points for the cleaning agent introduced through the air intake system, the operator can combine cleaning agents into a potent fuel-cleaning agent mixture which contacts only the surface area of the fuel injector nozzles, the intake valves and the combustion chambers of the engine. This mixture of fuel and cleaning agents acts to remove even the most stubborn carbon deposits in these areas.

Fuel systems of internal combustion engines store, deliver, transfer and process fuel through rigid enclosed passages, chambers, orifices and/or pumping/metering devices, all of which require regular internal cleaning to ensure proper operation and system life and to assure efficient performance. If regular cleaning is not performed, fuel contaminants, deposits of additives, or by-products of the combustion process can clog the system and cause premature wear of system components, thereby inhibiting the performance and delivery characteristics of the fuel system.

The air intake passages of many modern fuel injection systems also present another problem stemming from the fact that the systems spray fuel directly into the air stream just before the intake valves. Components in the intake manifold, from the air intake down to the point where the fuel injectors spray the fuel, are subject to formation of unwanted deposits caused by oil vapor from crankcase ventilation systems and exhaust gases from exhaust gas recirculation systems. These deposits contribute to form a "dirty" intake system which reduces performance of the engine substantially.

Compounding the problem, most modern engines also contain sensitive components in the path of air flow into the engine that can be affected by these deposits. Such components include: air flow meters, turbo chargers, throttle plates, throttle position sensors, idle air control valves, exhaust recirculation valves, air charged temperature sensors, intake valves, fuel injector nozzles, knock sensors, and safety valves, not all of which are present in all engines. Deposits on these components result in a wide variety of performance complaints, with the most common being unstable idle speed control and stumbling when cold. Moreover, the advantages of flushing the fuel and air intake system of the internal combustion engine without disassembly is well known. As discussed in the following U.S. patents, numerous methods and apparatuses have been proposed to facilitate this goal:

U.S. Pat. No. 4,197,140 to Swan

U.S. Pat. No. 4,520,773 to Koslow

U.S. Pat. No. 4,606,311 to Reyes et al.

U.S. Pat. No. 4,787,348 to Taylor

U.S. Pat. No. 4,877,043 to Carmichael

U.S. Pat. No. 4,989,561 to Hein et al.

U.S. Pat. No. 5,097,806 to Vataru et al.

U.S. Pat. No. 5,271,361 to Flynn

U.S. Pat. No. 5,287,834 to Flynn

U.S. Pat. No. 5,289,837 to Betancourt

U.S. Pat. No. 5,381,810 to Mosher

Koslow teaches a method and an apparatus for cleaning and testing the fuel injection system of a vehicle without disassembling the fuel injectors. The apparatus includes a device for feeding a solvent-fuel mixture, a control system and a series of connectors. The method includes a testing procedure which does not require disassembling the injectors. A critical step is running the apparatus to measure the flow through the fuel injection valve via a flow meter.

Reyes et al. teaches a method and an apparatus for cleaning the fuel injection system of a vehicle without disassembly. It includes a device for feeding a solvent-fuel mixture into the supply system of the engine and a control system for cleaning the injectors while running the engine.

Taylor describes a method and an apparatus for cleaning the internal body of a diesel engine, such as its internal components, injection pump, fuel injectors, fuel lines and so on. The Taylor system includes a fuel supply system, a chemical tank, filter means and other components.

Carmichael describes an apparatus on a cart having wheels for transporting it to an engine to be serviced. The apparatus contains a device for delivering a cleaning solution under pressure to the engine.

Vataru et al. describes a method of cleaning internal combustion engine fuel injector structures, valves and combustion chambers using a canister containing a prescribed mixture of engine fuel and cleaning solvent. The mixture is discharged into the engine components using pressurized gas to charge the canister.

Flynn describes a method and an apparatus for removing internal carbon deposits and related residue from an internal combustion engine. Flynn initially utilizes a priming pump to transfer priming fuel to the engine from an external fuel source while the engine is being cranked to start. An engine fuel pump is then used to transfer a combustible, carbon-removing conditioning fuel from the fuel source through the engine fuel system along a flow path which by-passes the priming pump to avoid restriction.

Flynn also teaches a method and an apparatus for removing internal carbon deposits and related residue from fuel injected and carbureted engines. The Flynn apparatus delivers fuel to the inlet port of the engine fuel pump while starting the engine and then delivers a mixture of normal fuel and a carbon cleaning agent to the fuel pump inlet. This fuel-cleaner mixture then passes through fuel injectors or carburetors to be ignited in the combustion chambers.

Betancourt describes an internal combustion engine purging system to clean out deposits of carbon and other substances that accumulate over time in a fuel system. The objective is accomplished by delivering a mixture of fuel and cleaning solution into the fuel intake ports while the engine is running, so that the engine pulls the mixture through the carburetor or injector jets.

Mosher describes an electronically controlled carbon-cleaning apparatus for removal of carbon deposits in an internal combustion engine. A microprocessor and associated electronics perform all control and user interface functions. The apparatus circulates a fuel-cleaner solution through the fuel injection system of the engine while it operates.

In order to remove carbon deposits and other contaminants, all of the foregoing systems require temporarily replacing the regular fuel supply of an internal combustion engine with a mixture of fuel and a cleaning agent. The mixture is then supplied under pressure to the engine to operate the engine at idle for a predetermined time period or until the solvent mixture is depleted. Because the cleaning agent does not go through the regular air intake system, this approach is not capable of cleaning a "dirty" intake system of a mechanical fuel injection system or modern port fuel injection system. Moreover, since the cleaning agent is introduced through the regular fuel supply system, the strength of the cleaning agent must be controlled very carefully to avoid damaging sensitive fuel system components. These components include diaphragms of fuel pumps or injection pumps, injector O-rings, injector springs, injector filter screens, rubber diaphragms in the fuel pressure regulator, as well as internal carburetor components, such as O-rings, diaphragms, floats, sensors, seals and gaskets.

To remove stubborn carbon deposits on the surfaces of injector nozzles, intake valves, and combustion chambers by the foregoing methods, a strong, and often "corrosive" cleaning agent is necessary. If such a solvent is introduced directly through regular fuel supply conduits, it can damage some or all of the aforementioned fuel system components. As a result, the various methods and apparatuses described in above patents are best suited for removing soft carbon deposits and other weaker contaminants in the fuel system, thereby preventing the build up of hard carbons and contaminants if used in the early stages of contamination. These systems are totally ineffective against hard carbon and contaminant build-up on the surfaces of fuel injector nozzles, intake valves, and combustion chambers, however, even after repeated applications.

Hein et al. describes a method and an apparatus for cleaning the intake system of an internal combustion engine. Hein et al. demonstrates methods for injecting solvent directly into the engine intake system and varying the duty cycle or timing of the injections, thereby controlling the solvent flow. A pumping unit and a solvent holding tank are included. In operation, normal fuel flow to the engine is disconnected and the engine runs solely on the combustion of the solvent introduced by a separate aerosol injector through the air metering block of the apparatus. Because of this mode of operation, the apparatus of Hein et al. is suitable for cleaning only the air intake system, intake valves and combustion chamber of an engine. Other parts, such as the fuel delivery system, cannot be cleaned in this way; however, there are also many sensitive components in the path of the air flow into the engine that can be affected by the same "corrosive" cleaning agent necessary to remove stubborn carbon deposits. These components include the idle air control valves, throttle plates, throttle position sensors, exhaust recirculation valves, air charged temperature sensors, knock sensors, air flow meters, turbo chargers, and safety valves.

In addition, the throttle plates and throttle position sensors of modern port fuel injection systems often have a special chemical coating on their surface. Many auto manufacturers warn against spraying the throttle plate with even commonly available carburetor/choke sprays for fear of damaging this coating. Many turbo chargers also rely on regular or special lubricating oil to float and lubricate the turbine during engine operation. The "corrosive" cleaning agents necessary to remove stubborn carbon deposits by the Hein method can also damage turbochargers by depriving them of necessary lubrication. Similarly, Hein's teachings cannot be used to removed stubborn carbon deposits in carburetor-equipped engines for fear of damaging the internal carburetor components with the same "corrosive" agents.

In view of the foregoing, there has long been a need for a simple, effective, and inexpensive method and system capable of removing stubborn carbon deposits and contaminants in fuel and air intake systems of internal combustion engines without damage to or disassembly of the systems.

SUMMARY OF THE INVENTION

The method and apparatus of the present invention act to remove hard carbon deposits and contaminants on the surfaces of fuel injector nozzles, intake valves, and combustion chambers without damaging other sensitive fuel or air intake system components. In addition, they flush fuel and air intake systems of an internal combustion engine at the same time and without complete system disassembly. All of this is accomplished in a simple and easily adaptable method which can be used to augment the numerous methods and apparatuses described above.

The foregoing and other advantages are achieved, in one embodiment of the invention, by: temporarily replacing the regular fuel supply of an internal combustion engine with a mixture of fuel and a first cleaning agent; supplying this mixture under pressure to the engine and operating the engine at idle speed; introducing a second cleaning agent into the air intake system of the engine; turning off the engine and restoring the regular fuel and air supply; and restarting and operating the engine at one or more speed settings to flush out carbon deposits and any cleaning agent. In another embodiment, the method involves causing an internal combustion engine to operate at idle speed, introducing and controlling the application rate of a second cleaning agent into the air intake system of the engine, turning off the engine after introducing the second cleaning agent, temporarily replacing the regular fuel supply of the engine with a mixture of fuel and a first cleaning agent, supplying this mixture under pressure to the engine, restarting and operating the engine at one or more idle speed settings for approximately 15 minutes, then again introducing and controlling the application rate of either the second or a different third cleaning agent into the air intake system, turning off the engine and restoring regular fuel and air supply to the engine and restarting and operating the engine at one or more speed settings to flush out carbon deposits and any cleaning agent. In a further embodiment, the method includes causing an internal combustion engine to operate at idle speed, introducing and controlling the application rate of a second cleaning agent into the air intake system of the engine, turning off the engine after introducing the second cleaning agent, temporarily replacing the regular fuel supply of the engine with a mixture of fuel and a first cleaning agent, supplying this mixture under pressure to the engine, restarting and operating the engine at one or more idle speed settings for approximately 15 minutes, again introducing and controlling the application rate of either the second or a different third cleaning agent into the air intake system, turning off the engine for approximately 10 minutes after introducing either the second or the third cleaning agent, restarting and operating the engine continuously at one or more idle speed settings for approximate 15 minutes, turning off the engine and restoring regular fuel and air supply to the engine, and restarting and operating the engine at one or more speed settings to flush out carbon deposits and any cleaning agent.

Further objects and advantages of the present invention will become apparent from the following portions of the specification, claims, and attached drawings.

DESCRIPTION OF THE PREFERRED EMBODIMENTS

Figure 1A:
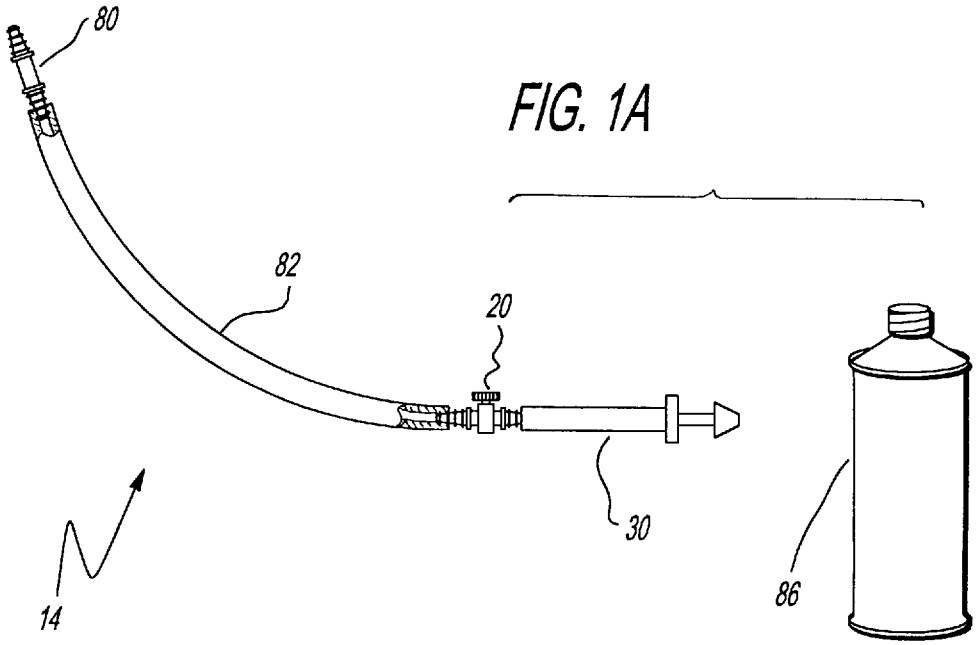
FIGS. 1A and 1B are perspective views of two different devices useful in the practice of the present invention to introduce a cleaning agent into the air intake system of an internal combustion engine, including certain connectors and components.
Figure 1B:
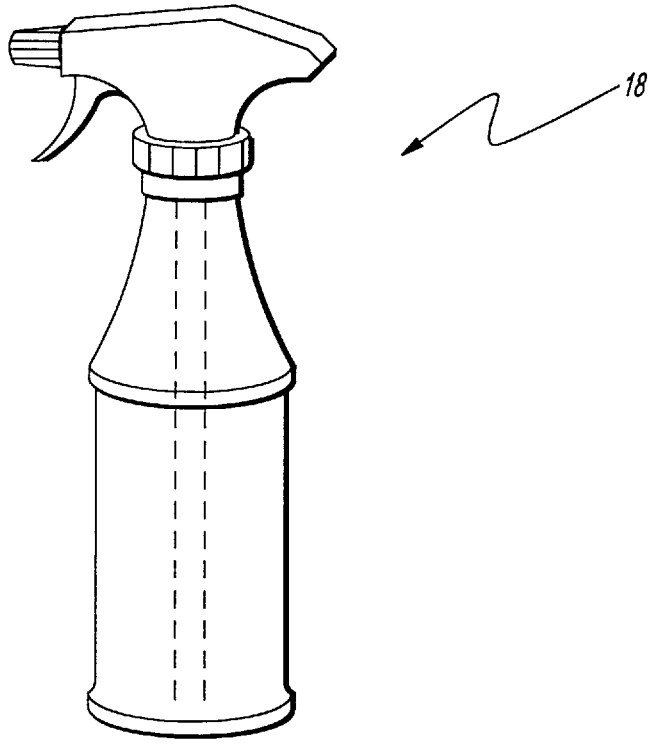
Figure 2:
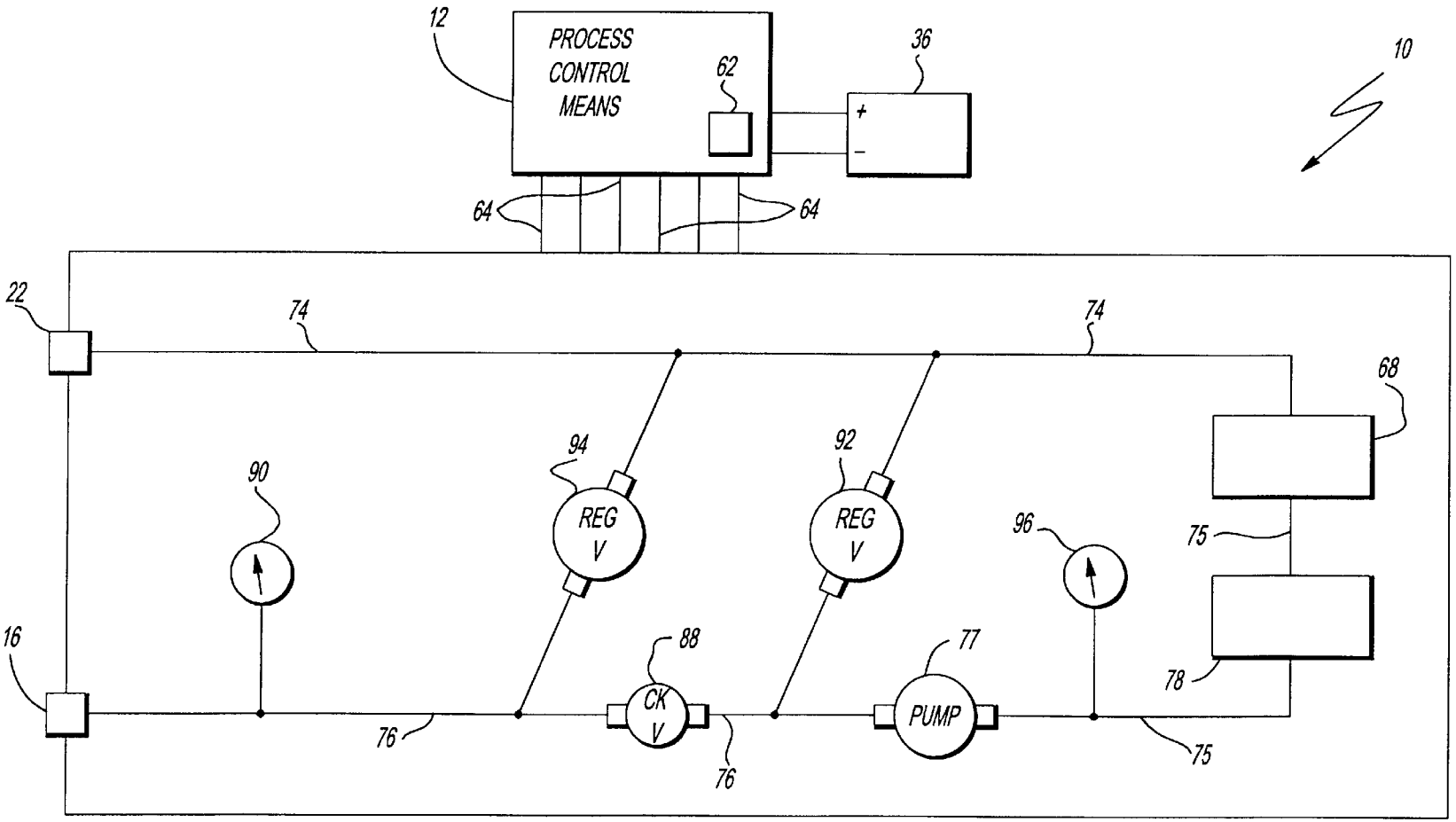
FIG. 2 is a simplified block diagram of a system useful in the practice of the present invention to introduce a mixture of fuel and a cleaning agent through the fuel supply system of an internal combustion engine.

Referring now to the drawings, FIGS. 1A, 1B and 2, taken together, illustrate a system constructed according to the present invention for thoroughly flushing the fuel and air intake systems of internal combustion engines. The system is designed to be hand carried or mounted on a mobile cart and is easily transported to an engine for cleaning. The apparatus of FIG. 2 comprises a machine module 10 and a process control apparatus 12 connected together by associated wiring and fluid conduits, whereas FIGS. 1A and 1B illustrate an air intake induction apparatus 14 and a direct air intake spraying apparatus 18, respectively, that can be physically separate from the machine module 10.

With reference to FIG. 1, the air intake induction apparatus 14 includes a storage device 86 and a valve apparatus 20 situated between a suction tube 30 and a transparent conduit 82. A vacuum hose adapter 80 is attached to a remote end of the transparent conduit 82.

The storage apparatus 86 stores a pre-determined amount of air intake cleaning agent for transfer through the vacuum hose adapter 80, the valve apparatus 20 and the suction tube 30. The valve apparatus 20 is preferably an adjustable needle valve for controlling the application rate of the agent, and the transparent conduit 82 may be a flexible, transparent polyurethane hose approximately 18 inches long for transferring the air intake cleaning agent to the vacuum hose adapter 80. The vacuum hose adapter 80 is, in turn, connected to one of the vacuum hoses of the engine to direct the cleaning agent into its air intake manifold.

The primary functions of the air intake induction apparatus 14 are: (1) storing the air intake cleaning agent; (2) supplying the air intake cleaning agent directly into air intake manifold; and (3) controlling the application rate of the air intake cleaning agent.

The air intake induction apparatus 14 is designed to introduce the air intake cleaning agent directly into the engine through one of several vacuum hoses connected to the air intake manifold. When the engine is running, the vacuum within the vacuum hoses should be strong enough to draw the air intake cleaning agent directly into the air intake manifold. The air intake induction apparatus 14 may be used in gasoline or methanol engines equipped with carburetors, mechanical fuel injection, throttle body fuel injection, or a port fuel injection system. For such engines, a plurality of rubber hoses are usually connected to the air intake manifold for various vacuum operated functions. For example, vacuum hoses might originate from the positive crankcase ventilation valve (PCV), brake booster, manifold pressure sensor (MAP), exhaust gas recirculation valve (EGR), distributor, charcoal canister purge port, or fuel pressure regulators. The general rules for selecting which vacuum line to use to connect to the air induction apparatus, in order of importance, are the following: (1) select the vacuum lines on the intake manifold that are downstream of the carburetors (do not select any vacuum lines running on or through the carburetors because the cleaning agent is usually not compatible with carburetors); (2) select PCV or brake booster vacuum lines for simple vacuum line identification, stronger suction vacuum, and minimum interference to normal engine operation during the cleaning process; (3) select the vacuum lines closest to the throttle plates for more even distribution of cleaning agent; and (4) select the vacuum line with the strongest vacuum for easier application of cleaning agent. After choosing and disconnecting the appropriate vacuum line, use the vacuum hose adapter apparatus 80 to connect the air intake induction apparatus 14 to the disconnected vacuum line.

Once the air intake induction apparatus has been connected to a vacuum hose of the engine, the valve apparatus 20 on the air intake induction apparatus 14 should be closed. When it is time to introduce the air intake cleaning agent, the suction tube 30 of air induction apparatus 14 is inserted into the storage apparatus 86 containing the cleaning agent. The valve apparatus 20 is then opened slightly to allow the suction vacuum within the air intake manifold to draw the air intake cleaning agent into the engine for combustion. The transparent conduit 82 can be used to visually verify the induction of cleaning agent. If required, the valve apparatus 20 can be adjusted slightly clockwise or counter-clockwise to control the application rate of the air intake cleaning agent into the engine. When finished, the valve apparatus 20 can be closed and the engine can be turned off.

With reference to FIG. 1B, the direct air intake spraying apparatus 18 includes a common trigger or compression-type spray head with an adjustable spray nozzle attached to a regular storage apparatus. A dip tube extends from the base of the spray head to the base of the storage apparatus.

The primary functions of the direct air intake spraying apparatus 18 are: (1) storing the air intake cleaning agent; (2) atomizing the air intake cleaning agent into fine mist; (3) supplying the finely atomized air intake cleaning agent directly into the air intake manifold; and (4) controlling the application rate of the air intake cleaning agent.

The direct air intake spraying apparatus 18 is also designed to introduce the air intake cleaning agent directly into the air intake manifold of an internal combustion engine. However, it is most often used in an internal combustion engine that does not have various vacuum lines connected to the air intake manifold. For example, a diesel engine would have to rely on the direct air intake spraying apparatus 18 to introduce any air intake cleaning agent. To avoid damaging the air filtering apparatus of the engine, it is often necessary to bypass any such apparatus before the application of the air intake cleaning agent. Once this is done, a proper amount of the air intake cleaning agent can be stored in the direct air intake spraying apparatus 18. After starting the engine, the trigger of the spray head is squeezed at appropriate times to spray the air intake cleaning agent directly into the air intake manifold. If necessary, the nozzle on the spray head can be adjusted to fine tune the atomization of the cleaning agent. The application rate of the air intake cleaning agent is controlled by increasing or decreasing the amount of cleaning agent sprayed into the intake manifold. Spraying is stopped and the direct air intake spraying apparatus 18 is moved away from the air intake manifold when finished.

With reference to FIG. 2, the process control apparatus 12 is supplied with electrical power from the power supply 36 to energize microprocessors, a process control timer, a pump, valves, switches, sensors, and to perform all monitoring and control functions. The process control apparatus 12 contains a process control timer as well as control switches and indicators, including mechanical pressure meters, and manually operated valves related to or comprising part of the machine module 10. The process control apparatus 12 may also contain logic circuits for automatic process selection, such as a microprocessor unit 62, for controlling and monitoring the functions and conditions of the apparatus. Electrical signal and power connections of the process control apparatus 12 are illustrated as interconnections 64 for powering and monitoring the machine module 10. The power supply 36 may be a direct current power supply, such as a motor vehicle battery.

Figure 3:
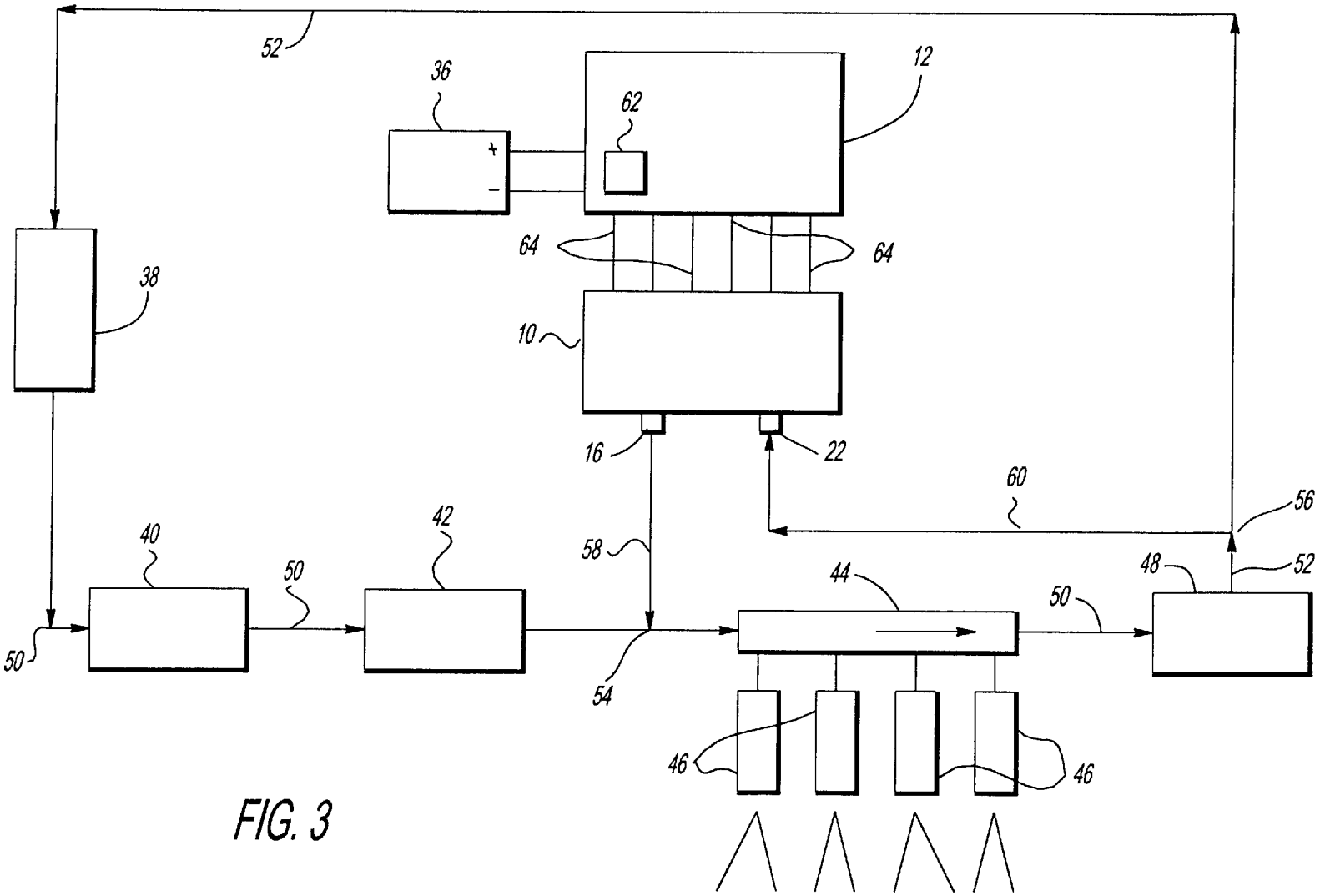
FIG. 3 is a schematic view of the system of FIG. 2 connected to the fuel system of an internal combustion engine, showing the flow of fluid during a fuel and air intake system flushing operation.

With reference to FIG. 2, the primary functions of the machine module 10 are: (1) storing the mixture of fuel and the first cleaning agent; (2) supplying the mixture of fuel and the first cleaning agent under normal pressure and flow requirements to the fuel system through the conduit 58 (FIG. 3); (3) receiving excess cleaning solution mixture through the conduit 60 (FIG. 3); (4) monitoring the pressure of fluid in the conduit 58 and the fuel distributing rail 44 (FIG. 3); and (5) filtering the cleaning solution mixture.

FIG. 2 includes a simplified schematic diagram of the fluid circuits contained in and comprising the machine module 10. A number of pressure and flow sensors and indicators, as well as their electrical pickup points, are not shown. Also omitted for clarity are the necessary electrical connectors for motors, as well as electrical monitoring lines.

The fluid storage tank 68 communicates with the inlet port 22 along a return conduit 74 and communicates with the outlet port 16 along a transfer conduit 75 and a supply conduit 76. Fluid passes through the conduits 74, 75 and 76 under the influence of a high capacity fluid pump 77 which is located between the transfer conduit 75 and the supply conduit 76 and is preferably capable of producing pressures up to 130 psi at flow rates of 20 GPH or more. A filter 78 is provided in the transfer conduit 75 to extract contaminants from the circulating fluid.

Other elements are also provided in the fluid circuit of the machine module 10 to determine the state of its operation and provide diagnostic analysis information on the user systems being cleaned. These include pressure meter 90 and check valve 88 associated with the supply conduit 76, as well as a fluid flow regulating valve 94 and a pressure regulating relief valve 92 connected individually across the return conduit 74 and the supply conduit 76.

Figure 4:
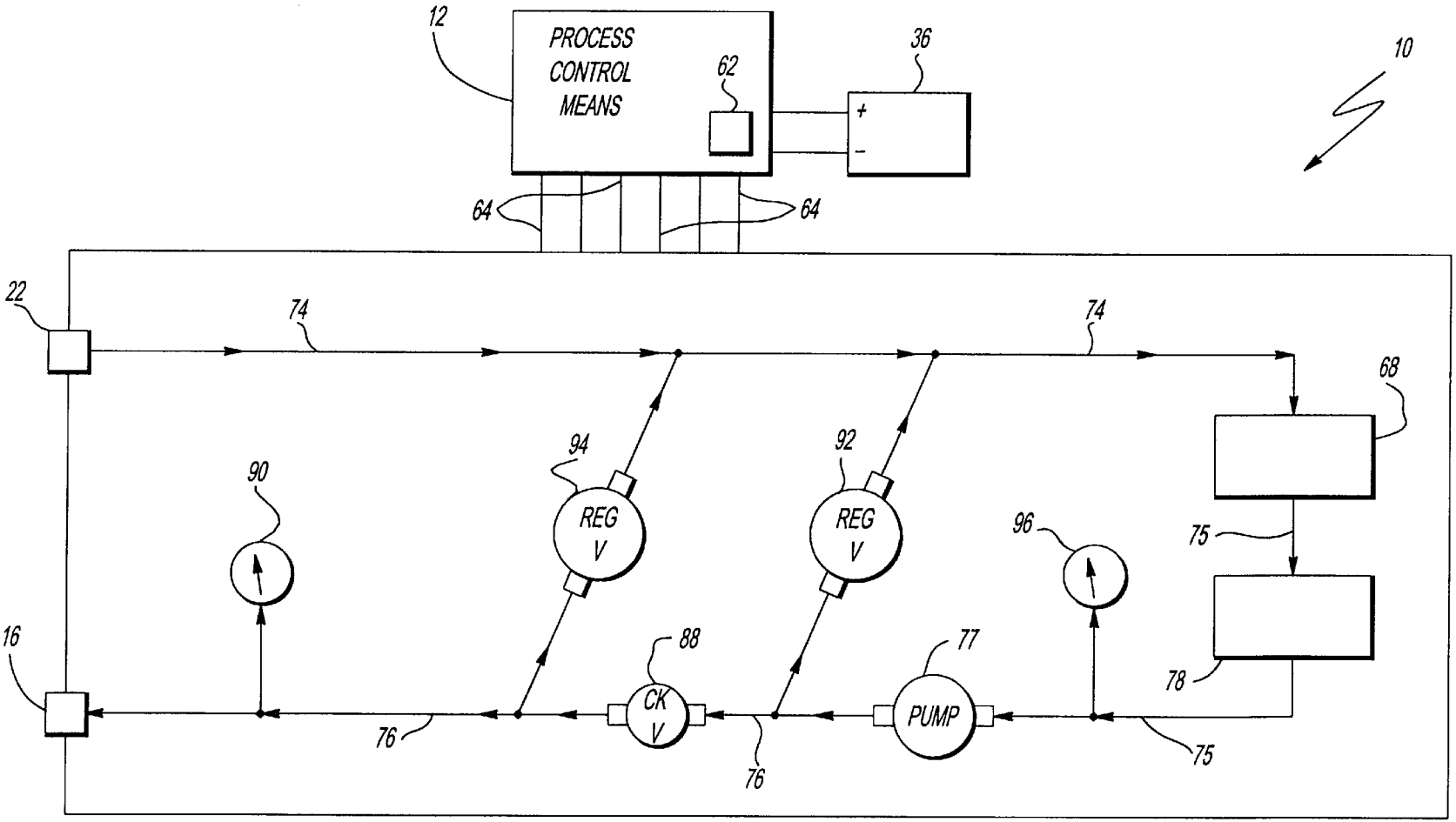
FIG. 4 is a simplified block diagram of the system of FIG. 2 which shows the flow of fluid during a fuel and air intake system flushing operation.

The following discussion describes the principal fluid circuits and operation of the machine module 10 in more detail. Referring now to the diagram of FIG. 4, which illustrates the machine module 10 being used to flush the fuel system, a mixture of fuel and the first cleaning agent is drawn from the fluid storage tank 68 by the fluid pump 77. This mixture passes through the filter 78 in the transfer conduit 75. The pressure meter 96 on the suction side of the pump 77 provides pressure level signals to sense blockage of filter 78. The fluid pump 77 is preferably a high capacity magnetic coupling-type pump which produces the high pressure and flow rate required. From the pump, the fluid flows through check valve 88 to the supply port 16 and the conduit 58 (FIG. 3). A pressure meter 90 is connected to the supply conduit 76 between the check valve 88 and the outlet port 16 to measure fluid pressure at the outlet port 16 or the conduit 58 (FIG. 3). Between the check valve 88 and the outlet port 16, the flow regulating valve 94, situated on the conduit extending between the supply conduit 76 and the return conduit 74, provides output fluid pressure and flow rate regulation. Between the fluid pump 77 and the check valve 88, the relief valve 92, which is situated on another conduit extending between the supply conduit 76 and the return conduit 74, provides output fluid over-pressure control. Both of these valves return excess fluid to the return conduit 74 at a location downstream of the inlet port 22, causing the fluid to return to the fluid storage tank 68.

When temporarily replacing the regular fuel supply of an internal combustion engine with a mixture of fuel and the first. cleaning agent stored in the machine module 10, the system operator preferably adjusts the pressure and flow rate of the mixture of fuel and the first cleaning agent through the outlet port 16 to the supply conduit 58 (FIG. 3). If an external fuel pressure regulator 48 (FIG. 3) is present in the engine fuel system, the operator turns the flow regulating valve 94 fully clockwise to its closed position. The fluid pressure required by the fuel system being serviced (usually between 4 psi to 100 psi) is then regulated by the fuel pressure regulator 48 and the fuel pressure is shown on the pressure meter 90.

If the engine is subsequently started, the mixture of fuel and the first cleaning agent is then sprayed into the combustion chambers by the fuel injectors 46 (FIG. 3). The pressure reading should then be about 3 to 5 psi lower than the pressure reading when the engine is off. The reading of the pressure meter 90 can be used to compare to the manufacturer's recommended setting. Any abnormal readings which persist after completion of the fuel and air intake system flushing indicate that other components of the engine's fuel system, such as the external fuel pressure regulator 48 or the fuel injectors 46 (FIG. 3), are defective. However, since about 90% of fuel system malfunctions are caused by internal contamination of fuel deposits, fuel additives and combustion by-products, the fuel and air intake system flushing operation described herein restore these systems to their normal operating condition in the vast majority of cases.

In fuel systems with no fuel pressure regulator 48, the operator adjusts the output fluid pressure to the manufacturer's recommended setting. This is accomplished by watching the pressure meter 90 for the pressure reading and adjusting the flow regulating valve 94 clockwise to the desired pressure setting. To relieve excess pressure in the machine module 10, the flow regulating valve 94 is turned counter-clockwise. Generally speaking, the recommended pressure setting for a carbureted fuel system is from 6 to 8 psi. For a diesel fuel system, the pressure setting is usually between 10 to 15 psi. In the above instances, the flow regulating valve 94 acts like a pressure control valve by allowing excess fluid to return to the fluid storage tank 68.

The over-pressure relief valve 92 provides an additional mechanism for setting the maximum safe operating pressure of the machine module 10 and the user fuel system being serviced. It is capable of being pre-set at the factory or field-set by the system operator.

Any excess of the mixture of fuel and the first cleaning agent enters the machine module 10 through the inlet port 22, and flows back to the fluid storage tank 68 for continued flushing. Of course, the above discussion of the fluid return circuit is not applicable to systems in which no return line is used. The operation of the fuel system flushing continues until the operator manually termintes it or the process control timer of the process control apparatus 12 runs out.

Finally, the size and capacity of the apparatus of the present invention is determined by its intended application. It can be sized to be mobile and easily moved, or built on a larger scale to service high capacity, stationary systems.

In the fluid circuitry described above, it should be understood that all of the illustrated valves can be manually operated valves, electrically operated solenoid valves, or hydraulically or pneumatically operated valves, and can be controlled either by the process control apparatus 12 or the machine module 10. In addition, the illustrated valve structures can take the form of individual combination valves or, in the alternative, a number of simple valves combined together to perform the more complex functions discussed. Each valve is therefore best described generally as a "valve apparatus" in the context of the present invention.

Referring now to FIG. 3, a preferred manner of connecting the machine module 10, the process control apparatus 12, and the power supply 36 to a fuel delivery system of an internal combustion engine is illustrated. It is to be understood, of course, that the fuel delivery system of FIG. 3 is only part of the fuel system of a typical internal combustion engine. Other fuel system components, such as throttle plates, intake manifolds, intake valves, combustion chambers, pistons, spark plugs, etc., are well understood in the industry but are omitted here for clarity. These other fuel system components will be thoroughly cleaned under normal combustion procedures and therefore require the engine to be turned on during the flushing operations of the present invention.

The illustrated portions of the fuel delivery system include a fuel tank 38, a fuel pump 40, a fuel filter 42, a fuel distributing rail 44, fuel injectors 46, a fuel pressure regulator 48, a fuel delivery line 50 (the fuel line from the fuel tank 38 to the fuel pressure regulator 48), and a fuel return line 52 (the fuel line from the fuel pressure regulator 48 back to the fuel tank 38). However, some of these components may not be present in many fuel systems. For instance, a carbureted fuel system does not have the fuel pressure regulator 48 and the fuel injectors 46. A carbureted system has one or more carburetor units in place of the injectors 46 and more than likely does not have the fuel return line 52. A diesel fuel system, on the other hand, does not have the fuel pressure regulator 48, but has an additional fuel injection pump. Therefore, the connection method of FIG. 2, which includes machine module 10, process control apparatus 12, power supply 36, and the fuel delivery system of the internal combustion engine, serves only to illustrate the basic arrangement of parts and the fluid flow direction. Generally, if the engine is turned on, fuel is drawn from the fuel tank 38 to the fuel delivery line 50, through the fuel pump 40 and fuel filter 42 to the fuel distributing rail 44. The fuel is then injected into the engine for combustion through the fuel injectors 46. Excess fuel is returned to the fuel tank 38 by the fuel return line 52. The fuel pressure regulator 48 maintains constant fuel pressure by allowing excess fuel to pass through the fuel return line 52.

The machine module outlet port 16 and the machine module inlet port 22 of the machine module 10 are connected to the fuel delivery system at a connection point 54 in the fuel output line 50 and at a connection point 56 in the fuel return line 50, respectively. These connections are made by fluid conduits 58 and 60. The connection point 54 in the fuel output line 52 is preferably located after the fuel filter 42 and before the fuel distributing rail 44, whenever possible. The fuel filter 42 is bypassed in this way to avoid flushing or dissolving the contaminants inside the fuel filter 42 to ensure that they are not carried into the rest of the fuel system by the specially formulated flushing solution and to avoid diluting the strength of the flushing solution. For example, the diesel fuel system sometimes has a large quantity of fuel inside the fuel filter 42 which would otherwise dilute the flushing solution. After the machine module 10 is connected at connection points 54 and 56, the fuel pump 40 is either disabled or the disconnected fuel lines 50 and 52 are connected together by an adapter means at connection points 54 and 56 to create an independent fuel loop, bypassing the fuel distributing rail 44, the fuel injectors 46 and the fuel pressure regulator 48.

In the arrangement shown in FIG. 3, the machine module 10 effectively replaces the fuel tank 38, the fuel pump 40, and the fuel filter 42 of the fuel delivery system. For any fuel system not utilizing fuel return lines, such as most carbureted fuel systems, the machine module 10 is connected to the fuel system only at the connection point 54 of the fuel delivery line 50, prior to the carburetor unit. The elements associated with the fuel return line 52 are not used.

The aforementioned arrangement of FIG. 3 and the advanced output fluid pressure and flow regulating capacity of the machine module 10 enable the system operator to duplicate any known fuel system pressure and flow requirements in any kind of internal combustion engine, such as gasoline, diesel or methanol fuel engines. In other words, the preferred apparatus that includes the machine module 10, the process control means 12, the wiring connection 64 and the power supply 36 are designed to duplicate the normal operating conditions of the fuel system, and therefore can be used to temporarily replace the regular fuel supply system of the engine.

Figure 5:
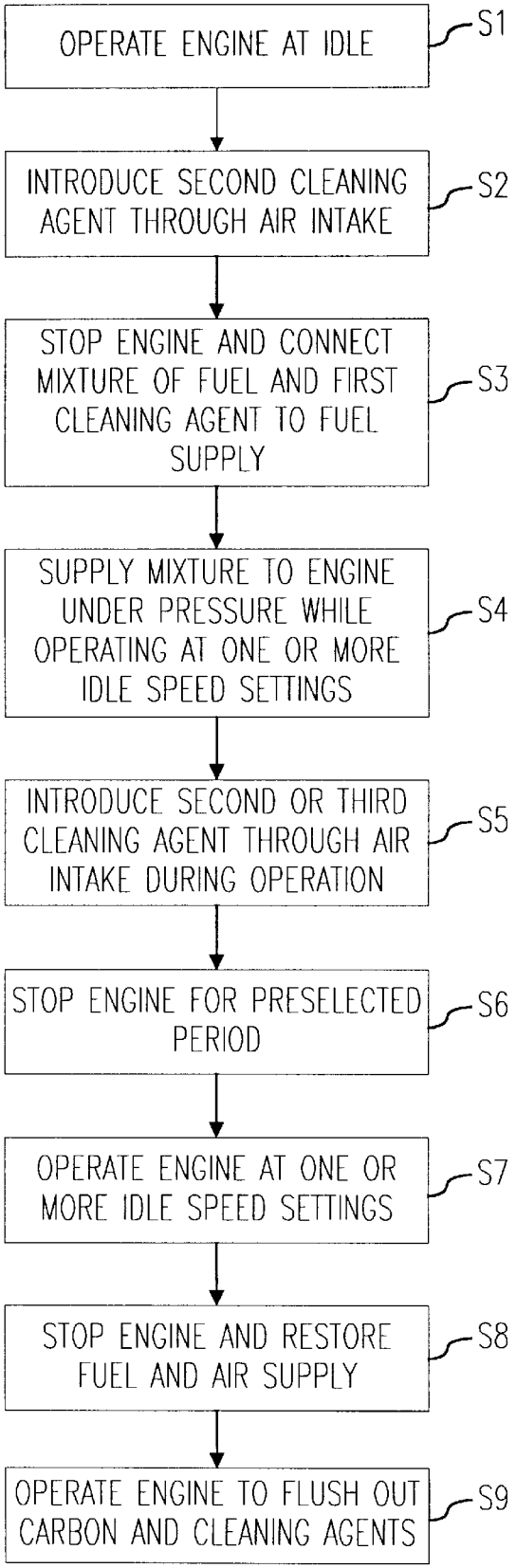
FIG. 5 is a flow chart illustrating the steps in a preferred method of utilization for flushing the fuel and air intake systems of an internal combustion engine.

FIG. 5, illustrates the sequence of steps in an exemplary process performed according to one preferred form of the invention on an internal combustion engine mounted in an automobile.

Step S1 of the process involves preparing the engine for a cleaning operation by starting it and waiting for the idle speed to become normal. A typical normal engine idle speed is usually less than 1200 revolutions per minute. For optimal cleaning results, the engine should be warmed up.

Step S2 involves introducing and controlling the application rate of a second cleaning agent into the air intake system of the engine. There are basically two approaches in step 2 for introducing the second cleaning agent into the air intake system of the engine.

One approach is using the air intake induction apparatus 14 to introduce the second cleaning agent through one of many vacuum hoses connected to the air intake manifold. There should be a vacuum strong enough within these vacuum hoses to draw the second cleaning agent directly into the air intake manifold. For gasoline or methanol engines equipped with either carbureted, mechanical fuel injection, throttle body fuel injection, or port fuel injection systems, there are usually many rubber hoses connected to the air intake manifold for various vacuum operated functions. For example, these vacuum hoses might lead to the positive crankcase ventilation valve (PCV), brake booster, manifold pressure sensor (MAP), exhaust gas recirculation valve (EGR), distributor, charcoal canister purge port, or fuel pressure regulators. As described previously, the general rules for selecting which vacuum line to use in order of importance are: (1) select a vacuum line on the intake manifold downstream of the carburetors (do not select any vacuum lines running to or through a carburetor because the cleaning agent introduced through the air intake system is usually not compatible with carburetors); (2) select PCV or brake booster vacuum lines for simple vacuum line identification, stronger vacuum, and minimum interference to normal engine operation during the cleaning process; (3) select a vacuum line closest to the throttle plates for more even distribution of cleaning agent; and (4) select the vacuum line with the strongest suction vacuum for easier application of the cleaning agent. Before starting the engine as described in step 1, the selected vacuum hose should be disconnected and an appropriate vacuum hose adapter apparatus 80 should be used to connect the air intake induction apparatus 14 to the disconnected vacuum line. Once this is done, the valve apparatus 20 on the air intake induction apparatus 14 is closed. When it is time to introduce the second cleaning agent into the air intake system of the engine, the suction tube 30 is inserted into a storage apparatus 86 containing the second cleaning agent. The valve apparatus 20 is then opened slightly to allow the vacuum within the air intake manifold to draw the second cleaning agent into the engine for combustion. If needed, the valve apparatus 20 is adjusted either clockwise or counter-clockwise to control the application rate of the second cleaning agent. At this time, it is normal for the engine RPMs to decrease and heavy smoke to discharge from the exhaust pipe. As long as the engine does not stall and the vibration of the engine is not excessive, introduction of the second cleaning agent should be continued at the same rate. If the engine continues to stall or the there is excessive vibration to the engine even at the minimum induction rate, the engine RPM should be increased slightly until the condition improves. The engine RPM should not be increased unnecessarily. The objective for introducing the second cleaning agent with the afore-mentioned method is simple: to allow sufficient time for the maximum amount of cleaning agent to make contact with hard carbon deposits and other contaminants in the air intake manifold and combustion chambers. After the application of the second cleaning agent is completed, the valve apparatus 20 is closed.

The second approach for introducing the second cleaning agent is to bypass the air filtering apparatus, atomize the second cleaning agent into fine mist and spray the second cleaning agent directly into the air intake manifold of the engine using the direct air intake spraying apparatus 18. This approach is usually applied to a diesel engine that has no vacuum lines on the air intake manifold. However, except for carburetor equipped engines, this approach might also be applied to gasoline and methanol engines with other types of fuel systems.

The application rate of the second cleaning agent may be controlled by varying the amount of the second cleaning agent sprayed into the intake manifold of the engine. At this time, it is normal for the engine RPM to decrease and for heavy smoke to emanate from the exhaust pipe. As long as the engine is still running and the vibration of the engine is not excessive, introduction of the second cleaning agent is continued at the same rate. If the engine begins to stall or there is excessive vibration of the engine at the minimum induction rate, the engine RPM is to be increased slightly until the condition improves. The engine RPM should not be increased unnecessarily, however. The objective of introducing the second cleaning agent with the afore-mentioned method is to allow sufficient time for a maximum amount of cleaning agent to make contact with hard carbon deposits and other contaminants in the air intake manifold and combustion chambers. After finishing the application of the second cleaning agent, the direct air intake spraying apparatus 18 is removed from the air intake system.

Step S3 involves turning off the engine after introducing a pre-determined amount of the second cleaning agent and temporarily replacing the regular fuel supply with a mixture of fuel and a first cleaning agent. After turning off the engine, there are many methods and apparatuses that can be used to temporarily replace the regular fuel supply with a mixture of fuel and the first cleaning agent. These methods and apparatuses are described in the following U.S. Patents: U.S. Pat. No. 4,197,140 (Swan); U.S. Pat. No. 4,520,773 (Koslow); U.S. Pat. No. 4,606,311 (Reyes); U.S. Pat. No. 4,787,348 (Taylor); U.S. Pat. No. 4,877,043 (Carmichael); U.S. Pat. No. 5,097,806 (Vataru); U.S. Pat. No. 5,271,361 (Flynn); U.S. Pat. No. 5,287,834 (Flynn); U.S. Pat. No. 5,289,837 (Betancourt); and U.S. Pat. No. 5,381,810 (Mosher); the specifications of which are hereby incorporated by reference for all purposes. However, for purposes of illustration, the apparatus of FIG. 2 shall be used as an example. As previously described, this apparatus stores a mixture of fuel and the first cleaning agent in the fluid storage tank 68 of machine module 10. Once this is accomplished, the fuel lines of the engine are disconnected and the machine module 10 is temporarily connected as described with regard to FIG. 3.

Step S4 involves supplying the mixture of fuel and the first cleaning agent under pressure to the engine while the engine operates at one or more idle speed settings for approximately 15 minutes. The machine module 10 should first be allowed to circulate a mixture of fuel and first cleaning agent under pressure to the engine for combustion, and then the engine should be restarted. The engine should be operated at normal idle speeds for approximately 5 minutes to mix the previously introduced second cleaning agent in step 2 with the newly introduced fuel-first cleaning agent mixture. This mixing process should take place ONLY in the area around intake ports, intake valves and combustion chambers of the engine, downstream of either the carburetors or injectors. Again, it is normal for the engine to run rough and heavy smoke may be released from the exhaust pipe. As long as the engine does not stall and does not vibrate excessively, it should be operated at a normal idle speed. If the engine keeps stalling or there is excessive vibration, the engine RPM should be increased slightly until the condition improves. The engine RPM should not be increased unnecessarily, however. After approximately 5 minutes of operating the engine at a normal idle speed, the engine should be accelerated periodically to blow out loosened or dissolved carbon deposits along with other contaminants from the exhaust pipe. In general, every acceleration step should include: (1) increasing the engine RPM up to but not in excess of two thirds full throttle, staying with the maximum throttle (⅔) from 2 to 3 seconds only and releasing the throttle immediately to normal idle speed; and (2) repeating the aforementioned acceleration procedure several times. The acceleration step should be repeated until there is almost no smoke coming out of exhaust pipe. If there is still smoke coming out of exhaust pipe, allow the engine to operate at a normal idle speed for approximately two minutes and repeat the acceleration step. If there is little or no smoke coming out of the exhaust pipe after the first acceleration step, operate the engine at normal idle speed for about two to three minutes and repeat the acceleration step. Repeat the acceleration step two or three times within 10 minutes of the first engine acceleration.

Step S5 involves introducing and controlling the application rate of either the second cleaning agent or a third cleaning agent into the air intake system of the engine. The method and apparatus used to introduce the cleaning agent are as described above for step S2. However, for optimum results, either the second or the third cleaning agent should be introduced into the air intake system immediately after the conclusion of one of the acceleration steps described in step 4. Again, it is normal for the engine to run rough and there may be heavy smoke released from the exhaust pipe. As long as the engine does not stall and does not vibrate excessively, it should be operated at a normal idle speed. If the engine stalls or the there is excessive vibration, the engine RPM should be increased slightly until the condition improves. Again, the objective here is simple: (1) to introduce the second cleaning agent or a different third cleaning agent from the air intake system at the SAME TIME as the mixture of fuel and the first cleaning agent is supplied under pressure through the regular fuel supply inlet to the engine; and (2) to allow sufficient time for the maximum amount of COMBINED cleaning agents as described in (1) to contact hard carbon deposits and other contaminants ONLY in the area around intake ports, intake valves and combustion chambers.

In step S6, the engine is turned off for approximately 10 minutes after either the second or the third cleaning agent is intruduced into it. Turning off the engine right after finishing the induction of either the second or the third cleaning agent enables the area around the intake ports, intake valves and combustion chambers to be heat soaked by the mixture of the combined cleaning agents introduced through regular fuel and air intake systems.

Step S7 involves restarting and operating the engine at one or more idle speed settings for approximately 15 minutes. The engine should be restarted and subjected immediately to the acceleration step (S4). This procedure removes almost all loosened or dissolved carbon deposits along with other contaminants from the exhaust pipe. The acceleration step should be repeated three to four times within approximately 15 minutes from the first engine acceleration.

Step S8 involves turning off the engine and restoring the regular fuel and air supply. After operating the engine as described in step S7 for approximately 15 minutes, the engine should be turned off and the machine module 10, the air intake induction apparatus 14, or the direct air intake spraying apparatus 18 should be removed from the fuel and air intake system of the engine. The regular fuel lines, vacuum hoses, air filtering apparatus etc., should then be reconnected to the engine.

Step S9 involves operating the engine at one or more speed settings to flush out carbon deposits or any excess cleaning agent remaining in the engine. The engine should be restarted and accelerated at idle, as described in step S4, for approximately 5 to 10 minutes to help flush out carbon deposits or any remaining cleaning agent. If the engine being serviced is on an automobile, test drive the vehicle for about 5 to 10 miles.

Naturally, the sequence described above could take place in a different order and some of the steps can possibly be omitted or varied. However, a full flushing operation of the type previously described is recommended for maximum effectiveness.

The most effective fuel and air intake system flushing agents known to the applicant for use in conjunction with the present invention are sold under the trade name POWER CLEAN 2000® Concentrated Fuel System Treatment and POWER CLEAN 2000® SP Treatment, respectively, manufactured by Power Clean 2000, Inc. of California. These cleaning agents are understood to be composed of both heavy and light napthas, aromatic hydrocarbons, certain alcohols and ketones, butyl-cellosolve or compounds similar to butyl-cellosolve. In addition, the cleaning agents used in the present invention should not contain any normal "corrosive" type solvents such as strongly basic, strongly acidic, or any chlorinated compounds.

However, it should be noted that the method and apparatus of the invention for flushing fuel and air intake systems are independent of the specific type of cleaning agent or agents used. Any cleaning agent is acceptable so long as it can be combined into a potent cleaning agent mixture on the surface area of fuel injector nozzles, intake valves and combustion chambers. This combination cleaning agent mixture is then used to achieve the primary goal of the present invention: to remove hard carbon deposits and contaminants on the surfaces of the fuel injector nozzles, intake valves and combustion chambers without damaging other sensitive fuel or air intake system components. For example, in one advantageous embodiment, the first, second and third cleaning agents used in the disclosed method all have different chemical compositions. However, it might be possible to substitute a single, special cleaning agent for the first, second and/or third cleaning agents described above. One way to accomplish this might be to vary the concentration of such a single cleaning agent for use as both fuel and air intake system cleaning agents. As long as the two cleaning agents are introduced together in the manner described in the present invention (basically simultaneously), a combination cleaning agent with an "effective" concentration higher than the original concentration might be just what is needed to remove hard carbon deposits and contaminants on the surfaces of fuel injector nozzles, intake valves, and combustion chambers. Therefore, in the above example, the present invention is not restricted to using two or three different kinds of cleaning agents with different chemical compositions as fuel and air intake cleaning agents.

From the above, it can be seen that the method and apparatus of the invention remove hard carbon deposits and contaminants on the surfaces of fuel injector nozzles, intake valves, and combustion chambers without any risk of damage to other sensitive fuel or air intake system components, and increase efficiency of time and labor in providing an improved method to flush the fuel and air intake systems of an internal combustion engine at the same time and without complete system disassembly.

The appended claims are, of course, not limited to the embodiments described herein, but rather are applicable to all variations and adaptations falling with the scope and spirit of the present invention. Alternative embodiments, methods of utilization and various modifications of the preferred embodiments and methods of utilization depicted, will be apparent from the foregoing description to those skilled in the art.

What is claimed is:

1. A method for removing carbon deposits from an internal combustion engine having a fuel supply system for supplying fuel from a fuel source and an air intake system, the method comprising the steps of:

introducing a mixture of fuel and a first cleaning agent through said fuel supply system while the engine operates;

simultaneously introducing a second cleaning agent into said air intake system;

discontinuing the introduction of said first and second cleaning agents; and operating the engine at one or more speeds to flush out carbon deposits.

2. The method of claim 1 wherein:

said first and second cleaning agents are different in composition.

3. The method of claim 1 wherein:

said first and second cleaning agents are the same in composition.

4. The method of claim 1 comprising the further step of:

operating said engine continuously at one or more idle speeds for approximately 15 minutes before introducing said second cleaning agent.

5. The method of claim 1 comprising the further step of:

turning off said engine for approximately 10 minutes after introducing said second cleaning agent; and thereafter restarting said engine and causing it to operate continuously at one or more idle speeds for approximately 15 minutes.

6. The method of claim 1 wherein the step of introducing a second cleaning agent into said air intake system comprises the steps of:

bypassing an air filtering apparatus of said air intake system;

atomizing said second cleaning agent into a fine mist and spraying said mist directly into an air intake manifold of said air intake system.

7. The method of claim 1 wherein the step of introducing a second cleaning agent into the air intake system of the engine comprises the step of:

introducing said second cleaning agent into the engine through a vacuum hose connected to an air intake manifold of the air intake system.

8. The method of claim 1 further comprising the step of:

controlling rate of application of said second cleaning agent into said engine.

9. An apparatus for removing carbon deposits from an internal combustion engine having a fuel supply system for supplying fuel from a fuel source and an air intake system, the apparatus comprising:

a fuel subsystem having a source of a first cleaning agent, said fuel subsystem being constructed and arranged to introduce a mixture of fuel and said first cleaning agent through said fuel supply system while the engine operates;

an air subsystem operable simultaneously with said fuel subsystem for introducing a second cleaning agent into said air intake system; and a mechanism for discontinuing the introduction of said first and second cleaning agents and for operating the engine at one or more speed settings to flush out carbon deposits.

* * * * *